US006506263B1

(12) United States Patent
Basaly et al.

(10) Patent No.: US 6,506,263 B1
(45) Date of Patent: Jan. 14, 2003

(54) SEALANT COMPOSITION

(75) Inventors: Mores Basaly, Roswell, GA (US); Dana Rothwell, Carnesvile, GA (US)

(73) Assignee: Houghton Metal Finishing Company, Alpharetta, GA (US)

( * ) Notice: Subject to any disclaimer, the term of this patent is extended or adjusted under 35 U.S.C. 154(b) by 0 days.

(21) Appl. No.: 09/714,411

(22) Filed: Nov. 17, 2000

Related U.S. Application Data

(60) Provisional application No. 60/166,163, filed on Nov. 18, 1999.

(51) Int. Cl.[7] ..... C23C 22/05; C23C 22/83; C09K 15/02; C09K 15/12

(52) U.S. Cl. ..... 148/272; 148/274; 148/275; 148/276; 252/389.53; 252/389.61; 252/395; 252/400.53; 252/400.61; 252/406

(58) Field of Search ..... 252/389.52, 389.53, 252/389.61, 393, 395, 396, 400.52, 400.53, 400.61, 404, 406, 407; 148/272, 274, 275, 276

(56) References Cited

U.S. PATENT DOCUMENTS

| | | | | |
|---|---|---|---|---|
| 2,008,733 | A | | 7/1935 | Tosterud |
| 3,171,797 | A | | 3/1965 | Klingenmaier |
| 3,767,474 | A | | 10/1973 | Cohn |
| 3,852,124 | A | | 12/1974 | Fassell |
| 4,121,980 | A | | 10/1978 | Gohausen et al. |
| 4,225,398 | A | * | 9/1980 | Hasegawa et al. |
| 4,235,682 | A | * | 11/1980 | Schneeberger et al. |
| 4,526,671 | A | | 7/1985 | Watanabe et al. |
| 4,531,979 | A | * | 7/1985 | Bohler et al. |
| 4,939,001 | A | | 7/1990 | Brodalla et al. |
| 5,123,930 | A | * | 6/1992 | Bitterli |
| 5,362,317 | A | | 11/1994 | Patel et al. |
| 5,374,455 | A | | 12/1994 | Patel et al. |
| 5,411,607 | A | * | 5/1995 | Basaly et al. |
| 5,478,415 | A | | 12/1995 | Massad et al. |

FOREIGN PATENT DOCUMENTS

| | | |
|---|---|---|
| EP | 0 122 129 A | 10/1984 |
| GB | 2254622 | 10/1992 |

* cited by examiner

*Primary Examiner*—Joseph D. Anthony
(74) *Attorney, Agent, or Firm*—Morgan, Lewis & Bockius LLP

(57) ABSTRACT

An aqueous composition for sealing anodically oxidized aluminum surfaces is described. The composition contains at least one surfactant, a magnesium salt, and a cobalt(II) salt. This composition demonstrates enhanced sealant properties.

A method for sealing anodically oxidized aluminum surfaces is also described. In this method, the aluminum is contacted with a composition containing at least one surfactant, a magnesium salt and a cobalt(II) salt.

16 Claims, No Drawings

SEALANT COMPOSITION

This application claims benefit under 35 U.S.C. §119(e) of U.S. Provisional Application No. 60/166,163, filed Nov. 18, 1999, which is herein incorporated by reference.

FIELD OF THE INVENTION

The invention relates to a composition for sealing anodically oxidized aluminum and aluminum alloy surfaces. More particularly, the invention relates to a sealant composition having improved sealing properties, such as resistance to stains and corrosive substances.

BACKGROUND OF THE INVENTION

Articles of aluminum or an aluminum alloy may be subjected to an anodic oxidation process to provide a protective coating or film of aluminum oxide on the aluminum surface. Such a process improves the hardness and corrosion resistance of the surface of the article and results in the formation of a uniform, translucent, highly porous aluminum oxide film. Generally, these anodic aluminum oxide films may be produced by placing the aluminum article in an acidic electrolyte solution and passing a direct electric current through the solution. Although the resulting anodic oxide layer is more resistant to corrosion than the untreated aluminum surface, the porous structure of the aluminum oxide layer ultimately renders it vulnerable to corrosion and degradation, particularly to that caused by external chemicals.

Therefore, to account for this porous structure, anodized aluminum oxide films and surfaces are commonly sealed with a sealing composition. It is currently theorized that the sealing process closes or fills the pores via hydration and/or precipitation of one or more compounds in the sealant composition. Aluminum articles treated in such a manner generally exhibit stronger resistance to the natural elements as well as external chemicals. Thus, sealed anodically oxidized aluminum surfaces are widely used when the aluminum surfaces may be subjected to severe environmental conditions.

Sealant compositions are well-known in the art. U.S. Pat. No. 3,852,124, herein incorporated by reference, describes a duplex sealing process which utilizes cobalt. U.S. Pat. Nos. 5,362,317 and 5,374,455, herein incorporated by reference, describe aluminum oxide sealant compositions comprising an alkaline earth metal salt and certain sulfonated compounds. U.S. Pat. No. 5,478,415, herein incorporated by reference, relates to a process and a composition for sealing anodically oxidized aluminum surfaces, the composition having an effective amount of a source of alkali metal ions, especially lithium ions. U.S. Pat. No. 4,939,001, herein incorporated by reference, describes a process of sealing decorative anodized aluminum oxide coatings in a hot aqueous solutions that contain 1-phosphonopropane-1,2,3-tricarboxylic acid, 1,1-diphosphonopropane-2,3-dicarboxylic acid, and/or alkali metal and/or alkanolamine salts of these acids. British Patent No. GB 2,254,622, herein incorporated by reference, discloses an aqueous sealant composition comprising at least one alkaline earth metal salt and a particular anti-smut compound. In addition to the patents described hereinabove, those references cited in these patents are also incorporated herein by reference.

There is a continuing need in the art for improved sealant compositions. Further, there is a need in the art for a sealant composition that exhibits enhanced sealant properties, such as corrosion inhibition and acid inhibition. This invention satisfies such needs.

SUMMARY OF THE INVENTION

This invention relates to an aqueous composition for sealing anodically oxidized aluminum surfaces. The composition contains at least one surfactant, a magnesium salt, and a cobalt(II) salt. This composition demonstrates enhanced sealant properties.

This invention also relates to a method of sealing anodically oxidized aluminum surfaces. In this method, the aluminum is contacted with a composition containing at least one surfactant, a magnesium salt and a cobalt(II) salt.

DETAILED DESCRIPTION

The sealant composition of this invention contains at least one surfactant, an effective amount of magnesium ion to achieve a seal, and a potentiating amount of cobalt(II).

The surfactants of this invention may be any surfactants known to be used in sealing compositions. Suitable surfactants include sodium dodecyl diphenyl oxide disulfonate (sold by Pilot Chemical Company under the product name Calfax DB-45), polytergent 2A-1, nonylphenol ethoxylate (sold by Huntsman Corporation under the product name Surfonic N-200), Monateric LF-100, Monateric LF-811, Monateric Cyna-50, Polystep B-27, steol, tamol and the nonoxynol series of surfactant under the Igepal name (e.g., Igepal CO-660, Igepal CO-710, Igepal CO-720, etc.).

Preferred surfactants are compounds of the following formula:

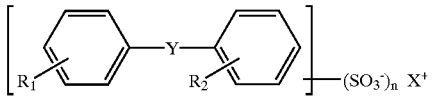

wherein Y is a direct bond or a group of the formula:

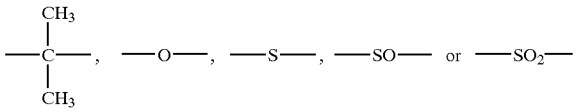

wherein $R_1$ and $R_2$ are each individually selected from H or $C_5$–$C_{22}$ alkyl, provided that $R_1$ and $R_2$ may not both be H; n has a value in the range of 1 to 4; and X is a counter-ion, such as $H^+$ or an alkali metal ion, such as $Na^+$.

The most preferred surfactants are compounds of the following formula:

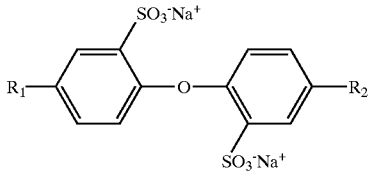

wherein $R_1$ and $R_2$ are each independently H or $C_{12}$–$C_{16}$ alkyl, provided that $R_1$ and $R_2$ may not both be H.

The source of magnesium ion used in a sealant composition of this invention is generally one or more of the magnesium salts that are well-known in the art. Suitable salts of magnesium include, without limitation, acetates, sulfates, hydroxides, nitrates, halides, and sulfamates, and mixtures thereof. Anions which contribute a buffering effect to the sealant composition are preferred. The acetate salt of magnesium is the most preferred salt.

The amount of magnesium ion needed to achieve a seal is well-known in the art. In this invention, the molar ratio of the magnesium salt to surfactant is preferably in the range from about 2:1 to about 20:1, more preferably in the range from about 4:1 to about 20:1, and most preferably in the range from about 10:1 to about 16:1. The weight ratio of the magnesium salt to the surfactant is preferably in the range from about 0.1:1 to about 30:1, more preferably in the range from about 0.5:1 to about 15:1, even more preferably in the range from about 1:1 to about 10:1, and most preferably in the range from about 3:1 to about 5:1.

The total combined concentration in the sealing composition of the magnesium salt and the surfactant is preferably in the range from about 1 to about 25 g/L, more preferably in the range from about 2 to about 10 g/L. Higher concentrations may be employed as needed to produce the desired sealant effect.

Suitable sources of cobalt(II) ion are those cobalt-containing compounds that, upon addition to an aqueous solution, result in disassociation of the cobalt(II) ion. Preferably, the cobalt(II) ion is an inorganic or organic salt of cobalt(II). Suitable sources of cobalt(II) ion include: cobalt(II) acetates, cobalt(II) nitrates, cobalt(II) chlorides, cobalt(II) carbonates, cobalt(II) bicarbonates, cobalt(II) oxides, cobalt(II) hydroxides, cobalt(II) bromates, and cobalt(II) oxalates. Cobalt(II) acetates and cobalt(II) acetate precursors are most preferred.

Although a wide number of cobalt(II) compounds may be used as the source of the cobalt(II) ion, certain counter ions are believed to interfere or inhibit the sealing process. Cobalt(II) compounds which are not well suited for sealant compositions include cobalt(II) phosphates and cobalt(II) silicates. Magnesium phosphates and magnesium silicates are also not well suited for sealant compositions. When the phosphates interact with unsealed aluminum oxide films, the surfaces of the films become difficult to seal. In particular, it has been found that phosphate concentrations of less than 20 ppm in a sealing bath can degrade sealing quality. Similar effects have been observed with silicate concentrations greater than 40 ppm.

The potentiating amount of cobalt(II), when used in accordance with this invention, produces a sealant which exhibits enhanced sealant properties, and, in particular, improved resistance to corrosive substances. A "potentiating amount" of cobalt(II) is an amount of cobalt(II) which, when added with the magnesium ion, improves the properties of the magnesium in the sealant composition. The potentiating amount of cobalt(II) ranges from about 10 to about 300 ppm, preferably about 30 to about 150 ppm, and most preferably about 50 to about 100 ppm. A greater or lesser amount of cobalt(II) than that in the potentiating range results in properties equal to or less desirable than those achieved without any cobalt(II).

The sealant composition of this invention may contain one or more conventional additives such as wetting agents, buffering agents, coupling agents (to increase the cloud point) and defoaming agents to enhance the quality of the sealed anodic aluminum surface. A preferred coupling agent is ethoxylated nonyphenol, also known as nonylphenol ethoxylate. A preferred defoaming agent is polyalloxane oil in water emulsion, a composition produced by Taylor Chemical Company under the product name TA-10 CP. The composition may also contain additional sealing additives to prevent the deposition of hydrated aluminum oxide crystals on the surface of the anodic aluminum oxide film, known as smut or bloom.

Smut is often encountered in sealing processes and greatly impairs the decorative or aesthetic appeal of anodized aluminum. Smut formation may occur when the hydrated aluminum oxide is degraded by light abrasion or contacted with human hands. Smut also interferes with attempts to bond sealed anodized aluminum surfaces. However, chemical and mechanical desmuting after-treatments introduce undesirable expense and may themselves adversely affect the overall quality of the sealed anodized aluminum film. Thus, the composition will preferably contain a sealant additive selected from the general class of organic smut inhibitors, but such an additive is preferably not an after-treatment additive.

Another embodiment of the invention involves a sealant composition concentrate. A preferred concentrate contains about 30% magnesium salt, about 15–20% total surfactant, about 2–5% cobalt(II) salt, with the balance being water and any optional additives.

As is known in the art, various processes may be employed to apply the sealant composition to the aluminum article. Sealing processes are well known in the art, and can generally be divided into three categories: (a) hydrothermal sealing processes; (b) mid-temperature sealing processes; and (c) low temperature sealing processes. A more detailed description of these three categories may be found in U.S. Pat. No. 5,478,415, herein incorporated by reference.

Generally, to seal an anodically oxidized aluminum surface, the anodically oxidized aluminum article is contacted with the aqueous sealant composition. Preferably, aluminum surfaces having anodized aluminum oxide films are contacted with the aqueous sealant composition by immersion of the aluminum surface in the solution at a desired temperature, pH range and for a time effective to provide the sealant effect. The preferred pH of the solution is in the range from about 5.2 to about 6.5, and the preferred temperature is in the range from about 170° F. to about 200° F.

The time of contact or immersion of the anodized aluminum surface or article with the aqueous sealant composition is a function of the thickness of the anodized aluminum oxide film. In general, the article should remain in contact with the sealant composition for a minimum of about three minutes with an additional minute for every 0.1 millimeter of anodized aluminum oxide film. Therefore, the aluminum article should remain in contact with the sealant composition for a time period directly relational to the desired thickness and density of the film. Preferrably, the article remains in contact with the sealant composition for about three to about 15 minutes.

Anodized aluminum surfaces suitable for sealing will typically be those prepared by known anodic oxidation processes. For example, suitable anodized aluminum surfaces will generally be those resulting from the process of (a) submerging the aluminum article into an acidic electrolyte solution, and (b) passing a DC electric current through the solution with the aluminum surface arranged as the anode and a counter electrode arranged as the cathode. Suitable acidic electrolyte solutions are those containing sulfuric acid, oxalic acid or sulfamic acid. The temperature of the electrolyte solution generally ranges from 32 to 90° F. Prior to submersion of the aluminum article in the electrolyte solution, the article preferably will be degreased and washed in a conventional manner.

The anodized aluminum oxide films to be sealed may be found on aluminum articles having a wide variety of shapes and configurations and resulting from numerous manufacturing and processing means. Illustrative examples of suitable aluminum articles are plates, pipes, rods, extruded bars with irregular or regular cross-sections, and articles formed by deep drawing and pressing. Decorative anodized aluminum surfaces, such as those that have been colored either electrolytically or with organic or inorganic dyes, may also be sealed with the composition of the invention. The term "aluminum" includes pure or substantially pure aluminum as well as alloys of aluminum containing, in general, at least about 50% by weight aluminum. Examples of other metals which may be present in such aluminum alloys are silicon, bismuth, copper, nickel, zinc, chromium, lead, iron, titanium, manganese, and the like.

The practice of the invention may be further appreciated from the following, non-limiting operating examples.

Tests

All examples were run using: water; a magnesium salt, such as magnesium acetate; a surfactant, such as sodium dodecyl diphenyl oxide disulfonate; a coupling agent, such as ethoxylated nonyphenol; and a defoaming agent, such as polyalloxane oil in water emulsion (a composition produced by Taylor Chemical Company under the product name TA-10CP.

The sealing properties of this invention were measured using tests well-known in the art, such as a dye stain test, a modified dye stain test and an acid dissolution test (ADT).

The following dye stain test was employed: Apply a drop of a dye consisting of 1 g of aluminum blue 2LW dye in 50 mL of distilled or deionized water. The pH of the dye should be 5.0±0.5. It is adjusted using acetic acid to lower and sodium hydroxide to raise the pH. Allow the spot from the drop to remain for 5 minutes. Wash the area with running water and then rub with pumice powder (NF or USP Fine Grade). Rinse and blot dry. The test area is then observed immediately and again after 24 hours. The article "passes" the seal test if no color from the dye is visible in the test area; the article "fails" the seal test if any color from the dye is visible.

The ASTM-B-136 Standard Method for Measurement of Stain Resistance of Anodic Coatings on Aluminum was employed as the modified dye stain test.

The ASTM B-680 Standard Method for Seal Quality of Anodic Coatings on Aluminum by Acid Dissolution was employed as the acid dissolution test (ADT).

EXAMPLES 1–13

In the following examples, anodized aluminum panels were prepared as follows: The panels first underwent treatment with Alkaline cleaner for five minutes followed by rinsing. Second, they underwent Etch treatment for five minutes followed by rinsing. Third, they underwent treatment with Deoxidize for two minutes followed by rinsing. Fourth, they were anodized for 33 minutes to a coating thickness of 0.7–0.8 mils and a current density of 18 ASF followed by rinsing. Fifth, they were treated for a period of ten minutes with one of the following sealant compositions that has been heated to a temperature of 180–190° F. at a pH in the range of 5.5 to 6.1.

Formula A, indicated in Table I, is a concentrate which is typically diluted with water to the final concentration indicated, e.g., 2%. When cobalt(II) ion is added, an aqueous cobalt(II) acetate was substituted for an equal amount of water. For example, when 4.01% cobalt(II) acetate solution is used, 18.69% water is used.

| Component | Formula A |
|---|---|
| water | 22.70 wt % |
| 50 wt % magnesium acetate solution | 60.00 wt % |
| Surfactant | 15.00 wt % |
| Coupling agent | 2.00 wt % |
| Defoaming agent | 0.30 wt % |

The sealant composition containing surfactant alone failed the modified dye stain test and the acid dissolution test. The sealant composition containing only surfactant and cobalt(II) ion also failed the modified dye stain test and the acid dissolution test. All magnesium-based sealants performed in an acceptable manner on all tests. However, when up to 300 ppm of cobalt(II) ions was added to such sealants, the results of these tests improved, particularly with respect to the acid dissolution test.

Examples 3–6, 9 and 10 of Table I were prepared in accordance with this invention. Examples 1, 2, 7, 8 and 11–13 of Table I were prepared as comparative examples. Examples 3–6, 9 and 10 of Table I illustrate the use of a potentiating amount of cobalt(II) in the sealant composition. Specifically, cobalt(II)-containing compositions tested in Examples 3–6, 9 and 10 exhibit superior results in the Acid Dissolution Test compared to (a) Examples 1 and 2, where a lesser than the potentiating amount of cobalt(II) was used; or (b) Examples 7 and 8, where a greater than the potentiating amount of cobalt(II) was used. Examples 5–8, where cobalt(II) is present in an amount of 200 ppm or greater, proved less satisfactory with respect to resistance to dye uptake. The results in Table I further indicate a potentiation effect for the cobalt(II), not merely an additive effect, because cobalt(II) ions alone cannot provide corrosion resistance. This is shown in comparative Examples 11–13.

TABLE 1

| Ex. | Formula (% by volume) | Quantity of cobalt(II) (ppm) | Dye Stain (0 hours) | Dye Stain (24 hours) | Modified Dye Stain (0 hours) | Modified Dye Stain (24 hours) | ADT ($mg/in^2$) (0 hours) | ADT ($mg/in^2$) (24 hours) |
|---|---|---|---|---|---|---|---|---|
| 1 | 2% A | 0 | PASS | PASS | Fail | PASS | — | PASS 1.80 |
| 2 | 3% A | 0 | PASS | PASS | PASS | PASS | — | PASS 1.80 |
| 3 | 3% A | 50 | PASS | PASS | PASS | PASS | — | PASS 0.43 |
| 4 | 3% A | 100 | PASS | PASS | PASS | PASS | — | PASS 0.59 |

TABLE 1-continued

| Formula Ex. | (% by volume) | Quantity of cobalt(II) (ppm) | Dye Stain (0 hours) | Dye Stain (24 hours) | Modified Dye Stain (0 hours) | Modified Dye Stain (24 hours) | ADT ($mg/in^2$) (0 hours) | ADT ($mg/in^2$) (24 hours) |
|---|---|---|---|---|---|---|---|---|
| 5 | 3% A | 200 | PASS | PASS | Fail | Fail | — | PASS 0.77 |
| 6 | 3% A | 300 | PASS | PASS | Fail | Fail | — | PASS 1.28 |
| 7 | 3% A | 400 | PASS | PASS | Fail | Fail | — | Fail 3.25 |
| 8 | 3% A | 500 | PASS | PASS | Fail | Fail | — | Fail 7.68 |
| 9 | 2% A | 50 | PASS | PASS | PASS | PASS | PASS 0.48 | PASS 0.46 |
| 10 | 2% A | 100 | PASS | PASS | PASS | PASS | PASS 1.05 | PASS 0.98 |
| 11 | 1% by wt surfactant | 0 | PASS | PASS | Fail | Fail | — | Fail 9.06 |
| 12 | 0.54% by wt surfactant | 50 | PASS | PASS | Fail | Fail | — | Fail 22.4 |
| 13 | 0.54% by wt surfactant | 100 | PASS | PASS | Fail | Fail | — | Fail 18.9 |

EXAMPLES 14–29

Examples 14–29 were conduced under process conditions; i.e., in a production plant. In the Examples 14–29, product formulations were made up to make baths to run seal quality tests. The formulations listed below were used. A 2% by volume bath was made using deionized water for each of the formulations listed below. The pH of each of the baths were taken and adjusted to a pH in the range of 5.80 to 6.00. Twenty four (24) panels (3×3 inches) were cut and labeled as to which seal they would be processed. Three (3) panels were anodized clear and 3 panels were electrolytically colored for each formula. Panels were processed through the standard anodizing process using sulfuric acid as the electrolytic solution. The following process was used: Clean for 5 minutes, rinse, Etch for 5 minutes, rinse, deoxidize for 2 minutes, rinse and anodize. The aluminum surfaces were Formulation 1

| Component | Percent by weight |
|---|---|
| water | 22.70 |
| 50 wt % magnesium acetate solution | 60.00 |
| Surfactant | 15.00 |
| Coupling agent | 2.00 |
| Defoaming agent | 0.30 |

Formulation 2:50 ppm Cobalt(II)

| Component | Percent by weight |
|---|---|
| water | 18.69 |
| 50 wt % magnesium acetate solution | 60.00 |

-continued

Formulation 2:50 ppm Cobalt(II)

| Component | Percent by weight |
|---|---|
| Cobalt(II) acetate solution | 4.01 |
| Surfactant | 15.00 |
| Coupling agent | 2.00 |
| Defoaming agent | 0.30 |

Formulation 3:100 ppm Cobalt(II)

| Component | Percent by weight |
|---|---|
| water | 15.70 |
| 50 wt % magnesium acetate solution | 60.00 |
| Cobalt(II) acetate solution | 7.00 |
| Surfactant | 15.00 |
| Coupling agent | 2.00 |
| Defoaming agent | 0.30 |

Formulation 4:200 ppm Cobalt(II)

| Component | Percent by weight |
|---|---|
| water | 6.66 |
| 50 wt % magnesium acetate solution | 60.00 |
| Cobalt(II) acetate solution | 16.04 |
| Surfactant | 15.00 |
| Coupling agent | 2.00 |
| Defoaming agent | 0.30 |

Examples 18–29 of Table 2 were run in accordance with the invention. Examples 14–17 were run as comparative examples. The results of Table 2 illustrate that adding cobalt(II) to the sealant composition of Formulation 1 produces an improved seal, thus demonstrating the improved sealant composition of this invention.

TABLE 2

| Ex. | Formulation | Cure time | Color | Coating thickness (mm) | Dye stain | Modified Dye stain | ADT ($mg/in^2$) |
|---|---|---|---|---|---|---|---|
| 14 | 1 | 2 hours | Clear | 0.61 | PASSED | Failed | 3.04 |
| 15 | 1 | 24 hours | Clear | 0.64 | PASSED | Failed | 1.96 |
| 16 | 1 | 2 hours | Bronze | 0.78 | PASSED | Failed | 2.91 |
| 17 | 1 | 24 hours | Bronze | 0.78 | PASSED | Failed | 1.85 |
| 18 | 2 | 2 hours | Clear | 0.70 | PASSED | PASSED | 0.39 |
| 19 | 2 | 24 hours | Clear | 0.68 | PASSED | PASSED | 0.33 |
| 20 | 2 | 2 hours | Bronze | 0.76 | PASSED | PASSED | 0.36 |
| 21 | 2 | 24 hours | Bronze | 0.77 | PASSED | PASSED | 0.28 |
| 22 | 3 | 2 hours | Clear | 0.66 | PASSED | PASSED | 0.58 |
| 23 | 3 | 24 hours | Clear | 0.72 | PASSED | PASSED | 0.34 |
| 24 | 3 | 2 hours | Bronze | 0.77 | PASSED | PASSED | 0.44 |
| 25 | 3 | 24 hours | Bronze | 0.80 | PASSED | PASSED | 0.39 |
| 26 | 4 | 2 hours | Clear | 0.65 | PASSED | Failed | 0.65 |
| 27 | 4 | 24 hours | Clear | 0.68 | PASSED | PASSED | 0.49 |
| 28 | 4 | 2 hours | Bronze | 0.76 | PASSED | Failed | 2.32 |
| 29 | 4 | 24 hours | Bronze | 0.78 | PASSED | PASSED | 0.90 |

While the best modes for carrying out the invention have been described in detail, those familiar with the art to which the invention pertains will recognize alternative designs and embodiments for practicing the invention as defined by the following claims.

What is claimed is:

1. A method of sealing an anodically oxidized aluminum article, comprising contacting an anodically oxidized aluminum article with an aqueous bath comprising:

a. at least one surfactant of the formula:

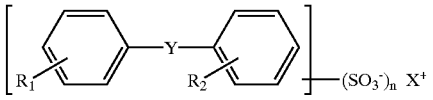

wherein Y is a direct bond or a group of the formula:

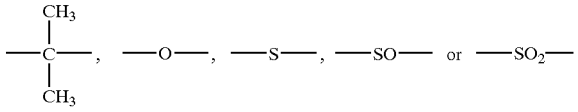

wherein $R_1$ and $R_2$ are each individually selected from H or $C_5$–$C_{22}$ alkyl, with the proviso that $R_1$ and $R_2$ may not both be H; n has a value in the range of 1 to 4; and X is a counter-ion or an alkali metal ion;

b. a magnesium salt, wherein the amount of magnesium ion is effective to achieve a seal;

c. a cobalt(II) salt, wherein the amount of cobalt(II) salt is effective to potentiate the sealing effect of said magnesium ion, said potentiating amount of cobalt(II) ranging from about 10 to 300 ppm; and d. water;

to form a sealed anodically aluminum surface, wherein said anodically oxidized aluminum surface exhibits improved resistance to stains and corrosive substances.

2. The method of claim 1, wherein the oxidized aluminum surface is anodized by a process comprising:

(a) submerging said oxidized aluminum surface in an acidic electrolyte solution, and (b) passing a DC electric current through said acidic electrolyte solution with said aluminum surface arranged as the anode and a suitable counter electrode arranged as the cathode.

3. The method of claim 1, wherein the aluminum article is selected from the group consisting of: plates, pipes, rods, extruded bars with irregular or regular cross-sections, and articles formed by deep drawing and pressing.

4. The method of claim 1, wherein the bath is prepared by the process comprising:

a. providing a sealant composition concentrate comprising:

i. at least one surfactant;

ii. a magnesium salt;

iii. a cobalt(II) salt; and iv. optionally, additives; and b. diluting said concentrate with water.

5. An aqueous composition for sealing an anodically oxidized aluminum surface, comprising;

a. at least one surfactant of the formula:

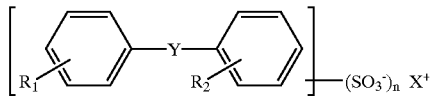

wherein Y is a direct bond or a group of the formula:

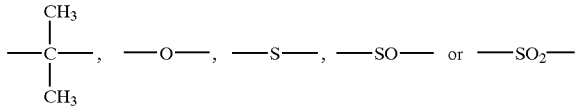

wherein $R_1$ and $R_2$ are each individually selected from H or $C_5$–C22 alkyl, with the proviso that $R_1$ and $R_2$ may not both be H; n has a value in the range of 1 to 4; and X is a counter-ion or an alkali metal ion;

b. a magnesium salt, wherein the amount of magnesium ion is effective to achieve a seal;

c. a cobalt(II) salt, wherein the amount of cobalt(II) salt is effective to potentiate the sealing effect of said magnesium ion, said potentiating amount of cobalt(II) ranging from about 10 to 300 ppm; and d. water.

6. The composition according to claim 2, wherein the surfactant is a compound of the formula:

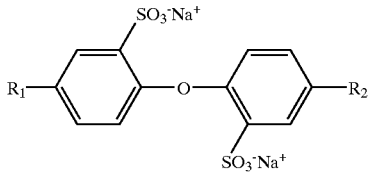

wherein $R_1$ and $R_2$ are each independently H or $C_{12}$–$C_{16}$ alkyl, with the proviso that $R_1$ and $R_2$ may not both be H.

7. The composition according to claim 5, wherein the molar ratio of said magnesium ion to said surfactant is in the range of about 2:1 to about 20:1.

8. The composition according to claim 5, wherein the weight ratio of said magnesium ion to said surfactant is in the range of about 0.1:1 to about 30:1.

9. The composition according to claim 5, wherein the combined concentration of said magnesium ion and said surfactant is in the range of about 1 to about 25 g/L.

10. The composition according to claim 5, wherein the potentiating amount of cobalt(II) ranges from about 30 to about 150 ppm.

11. The composition according to claim 10, wherein the potentiating amount of cobalt(II) ranges from about 50 to about 100 ppm.

12. The composition according to claim 5, wherein the magnesium salt is selected from the group consisting of: acetates, sulfates, hydroxides, nitrates, halides, sulfamates, and mixtures thereof.

13. The composition according to claim 12, wherein the magnesium salt is an acetate.

14. The composition according to claim 5, wherein the cobalt(II) salt is selected form the group consisting of: cobalt(II) acetates, cobalt(II) nitrates, cobalt(II) chlorides, cobalt(II) chlorides, cobalt(II) carbonates, cobalt(II) bicarbonates, cobalt(II) oxides, cobalt(II) hydroxides, cobalt (II) bromates and cobalt(II) oxalates.

15. The composition according to claim 14, wherein the cobalt(II) salt is a cobalt(II) acetate.

16. An aqueous composition for sealing an anodically oxidized aluminum surface, comprising:

a. a compound of the formula:

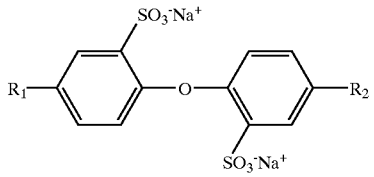

wherein $R_1$ and $R_2$ are each independently H or $C_{1-6}$ alkyl, with the proviso that $R_1$ and $R_2$ may not both be H;

b. magnesium acetate, wherein the amount of magnesium ion is effective to achieve a seal;

c. cobalt(II) acetate, wherein the amount of cobalt(II) ion is effective to potentiate the sealing effect of said magnesium ion, said potentiating amount of cobalt(II) ranging from about 10 to about 300 ppm; and d. water.

* * * * *